US005454415A

United States Patent [19]

Bolling et al.

[11] Patent Number: 5,454,415

[45] Date of Patent: Oct. 3, 1995

[54] CHILD SAFETY WINDOW SCREEN

[76] Inventors: Jocelyn G. Bolling; Sterling R. Bolling, Jr., both of 2112 Hidden Valley La., Silver Spring, Md. 20904

[21] Appl. No.: 206,608

[22] Filed: Mar. 7, 1994

[51] Int. Cl.[6] ..... E06B 3/68

[52] U.S. Cl. ..... 160/105; 49/55

[58] Field of Search ..... 160/105, 327, 160/351, 215, 368.1; 49/50, 55, 57, 465

[56] References Cited

U.S. PATENT DOCUMENTS

| | | | |
|---|---|---|---|
| 1,123,930 | 1/1915 | Ryan | 160/105 |
| 1,702,395 | 2/1929 | Anderson | 160/105 |
| 4,272,922 | 6/1981 | Prager | 49/55 |
| 4,394,805 | 7/1983 | Napper | 49/57 X |
| 4,628,635 | 12/1986 | Maillard | 49/55 |
| 4,653,226 | 3/1987 | Woodrow | 49/50 X |
| 5,311,701 | 5/1994 | Psaros | 160/105 X |

FOREIGN PATENT DOCUMENTS

| | | | |
|---|---|---|---|
| 2198172 | 6/1988 | United Kingdom | 49/55 |

*Primary Examiner*—David M. Purol

[57] ABSTRACT

A child safety window screen for preventing a child from falling through a window comprising, in combination an elongated top rail extended across a frame of an opened window; an elongated bottom rail offset from the top rail and extended cross a frame of an opened window; and a screen coupled between the top rail and bottom rail creating an extended configuration for shielding an opened window.

1 Claim, 4 Drawing Sheets

CHILD SAFETY WINDOW SCREEN

BACKGROUND OF THE INVENTION

1. Field of the Invention

The present invention relates to a child safety window screen and more particularly pertains a child safety window screen for preventing a child from falling through an opened window.

2. Description of the Prior Art

The use of screens is known in the prior art. More specifically, screens heretofore devised and utilized for the purpose of shielding opened windows are known to consist basically of familiar, expected and obvious structural configurations, notwithstanding the myriad of designs encompassed by the crowded prior art which have been developed for the fulfillment of countless objectives and requirements.

By way of example, U.S. Pat. Des. No. 323,481 to Freeman discloses a removable screen for a vehicle window; U.S. Pat. No. 3,871,434 to Hance discloses a security screen for window; U.S. Pat. No. 4,232,310 to Wilson discloses a protective window screen assembly; U.S. Pat. No. 5,081,793 to Mauro discloses a wood clad window assembly and associated method; and U.S. Pat. No. 5,090,469 to Boulanger discloses a window screen apparatus and method for making.

While these devices fulfill their respective, particular objective and requirements, the aforementioned patents do not describe a child safety window screen that is portable in design and can be adjusted to fit within a variety of different sized window frames.

In this respect, the child safety window screen according to the present invention substantially departs from the conventional concepts and designs of the prior art, and in doing so provides an apparatus primarily developed for the purpose of preventing a child from falling through an opened window.

Therefore, it can be appreciated that there exists a continuing need for new and improved child safety window screen which can be used for preventing a child from falling through an opened window. In this regard, the present invention substantially fulfills this need.

SUMMARY OF THE INVENTION

In the view of the foregoing disadvantages inherent in the known types of screens now present in the prior art, the present invention provides an improved child safety window screen. As such, the general purpose of the present invention, which will be described subsequently in greater detail, is to provide a new and improved child safety window screen and method which has all the advantages of the prior art and none of the disadvantages.

To attain this, the present invention essentially comprises, in combination, an elongated top rail having an upper edge, a lower edge, and an intermediate portion therebetween, the upper edge having a U-shaped channel formed thereon adapted for receiving and holding the bottom end of a window sash therein, the intermediate portion having an aperture axially disposed therethrough; an elongated bottom rail having an upper edge, a lower edge, and an intermediate portion therebetween, the intermediate portion having an aperture axially disposed therethrough, the lower edge having a plurality of spaced and aligned aperatures disposed thereon; an essentially rectangular and flexible screen having an upper edge coupled to the lower edge of the top rail and a lower edge coupled to the upper edge of the bottom rail; a top rod slidably disposed within the aperture of the top rail and a bottom rod slidably disposed within aperture of the bottom rail, each rod having a first member threadably received in a second member to allow axial extension thereof for coupling within the frame of an opened window, each rod positioned within the frame of an opened window at a distance offset from the other rod such that the screen is extended therebetween, thus shielding the opening, each end of each rod having a tip coupled thereto for preventing slippage within the frame; a plurality of open spaces disposed on the top rail and bottom rail for allowing access to each rod therein for extension or retraction thereof; an L-shaped bracket having a base leg coupled to a downwardly extending cross leg with the base leg adapted to be positioned to contact a bottom edge of a frame of an opened window and the cross leg adapted to be positioned to abut a side edge of a frame of an opened window, each leg having a plurality of spaced and axially aligned apertures disposed thereon; a first set of screws, each screw disposed through an aperture on the base leg of the L-shaped bracket and coupled within an aperature on the lower edge of the bottom rail, whereby securing the L-shaped bracket to the bottom rail; a second set of screws, each screw disposed through an aperture on the cross leg of the L-shaped bracket and coupled to a side edge of the frame of an opened window, whereby preventing inadvertent movement of the bottom rail and bottom rod, thus allowing the screen to be held in an essentially stationary position within a frame of an opened window.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved child safety window screen which has all the advantages of the prior art screens and none of the disadvantages.

It is another object of the present invention to provide a new and improved child safety window screen which may be easily and efficiently manufactured and marketed.

It is a further object of the present invention to provide a new and improved child safety window screen which is of durable and reliable construction.

An even further object of the present invention is to provide a new and improved child safety window screen which is susceptible of a low cost of manufacture with regard to both materials and labor, and which accordingly is then susceptible of low prices of sale to the consuming public, thereby making such a child safety window screen economically available to the buying public.

Still yet another object of the present invention is to provide a new and improved child safety window screen which provides in the apparatuses and methods of the prior art some of the advantages thereof, while simultaneously overcoming some of the disadvantages normally associated therewith.

Even still another object of the present invention is to provide a new and improved child safety window screen for preventing a child from falling through an opened window.

Lastly, it is an object of the present invention is to provide a new and improved child safety window screen comprising an elongated top rail extended across a frame of an opened window; an elongated bottom rail offset from the top rail and extended cross a frame of an opened window; and a screen coupled between the top rail and bottom rail creating an extended configuration for shielding an opened window.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
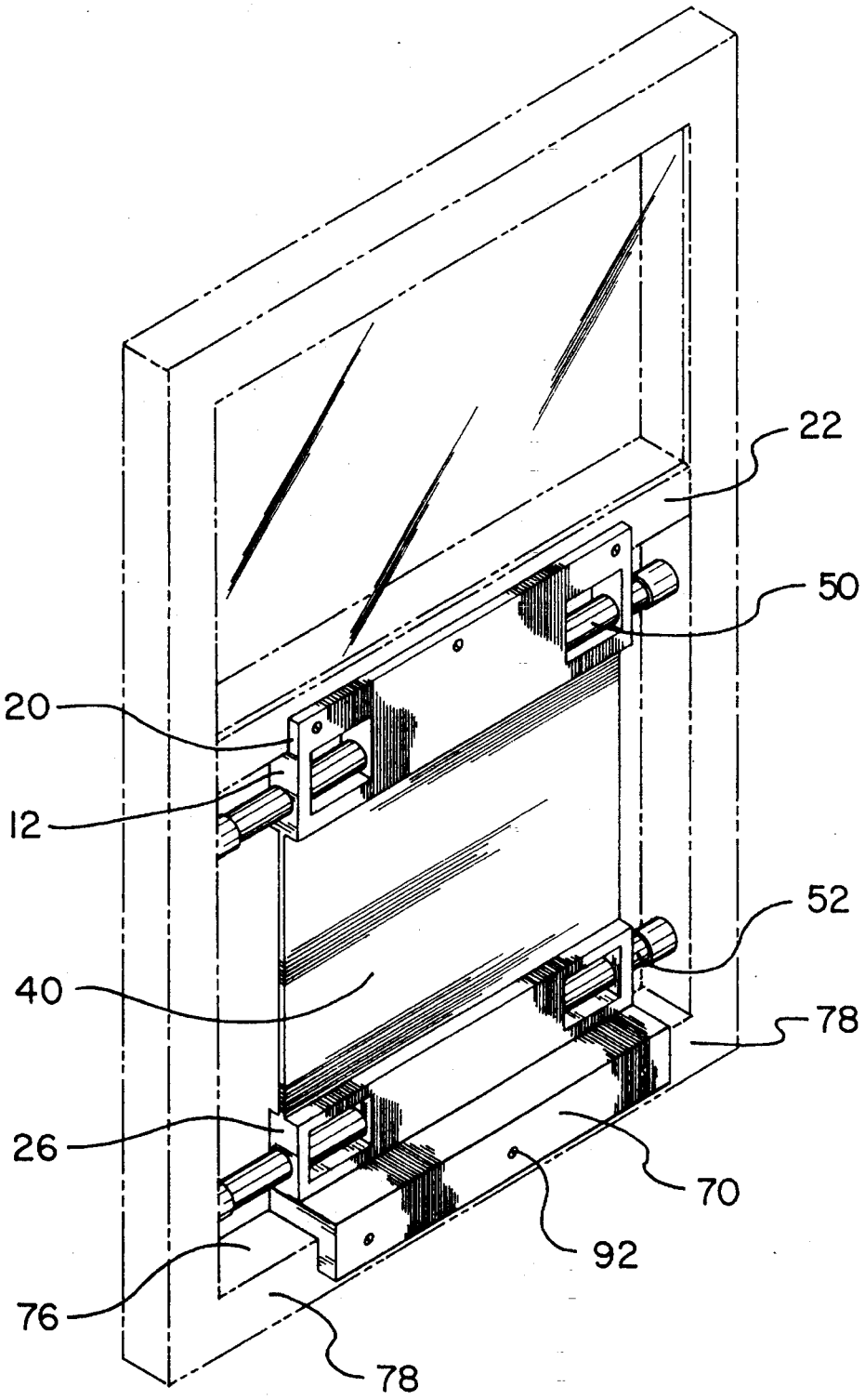
FIG. 1 is a perspective view of the preferred embodiment of the child safety window screen constructed in accordance with the principles of the present invention.
Figure 2:
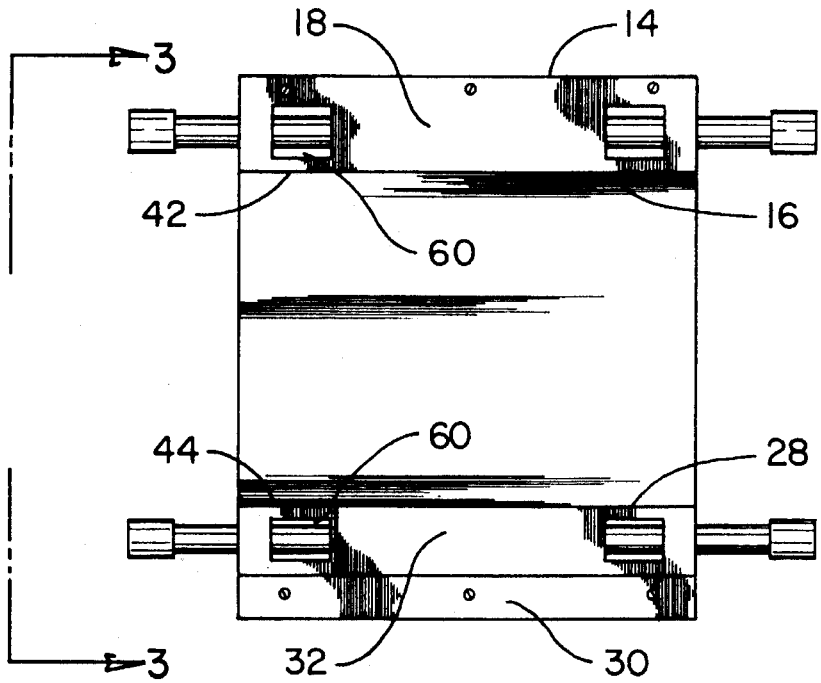
FIG. 2 is a front elevational view of the preferred embodiment of the invention shown in FIG. 1.
Figure 3:
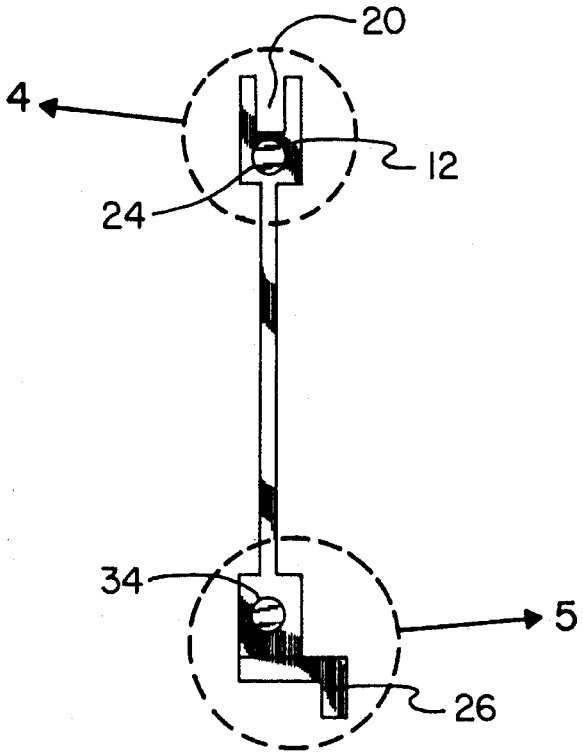
FIG. 3 is a side elevational view of the present invention taken along the line 3—3 of FIG. 2.
Figure 4:
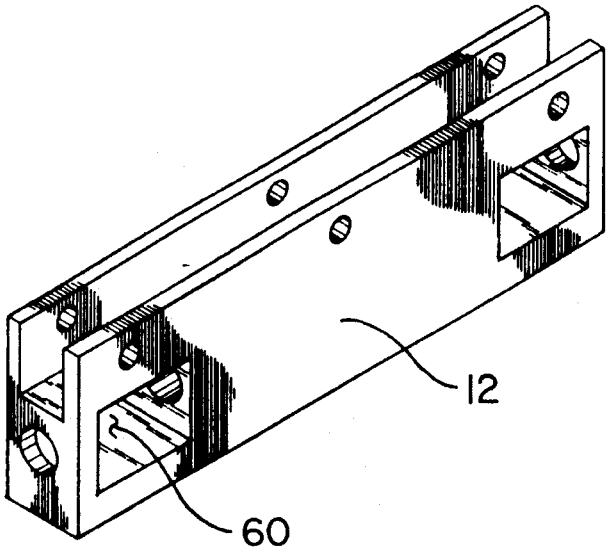
FIG. 4 is a perspective view of the top rail as shown in FIG. 3.
Figure 5:
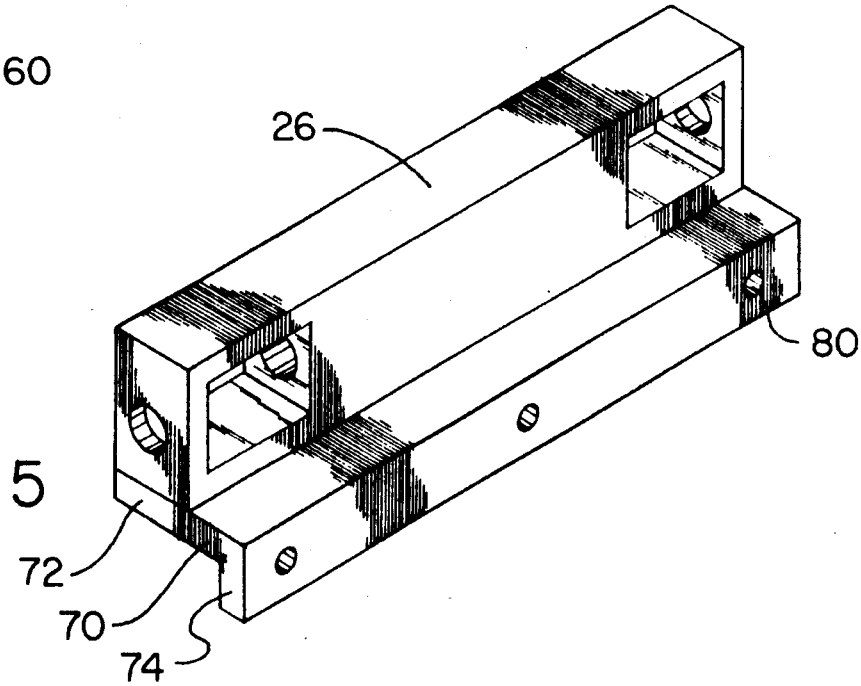
FIG. 5 is a perspective view of the bottom rail and L-shaped bracket as shown in FIG. 3.
Figure 6:
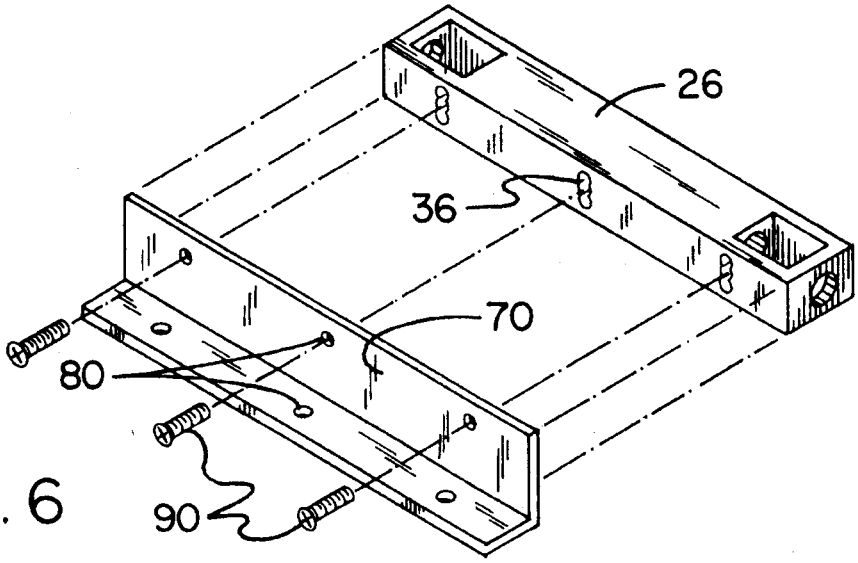
FIG. 6 is an exploded view of the L-shaped bracket, bottom rail, and screws taken along the line 6—6 of FIG. 5.
Figure 7:
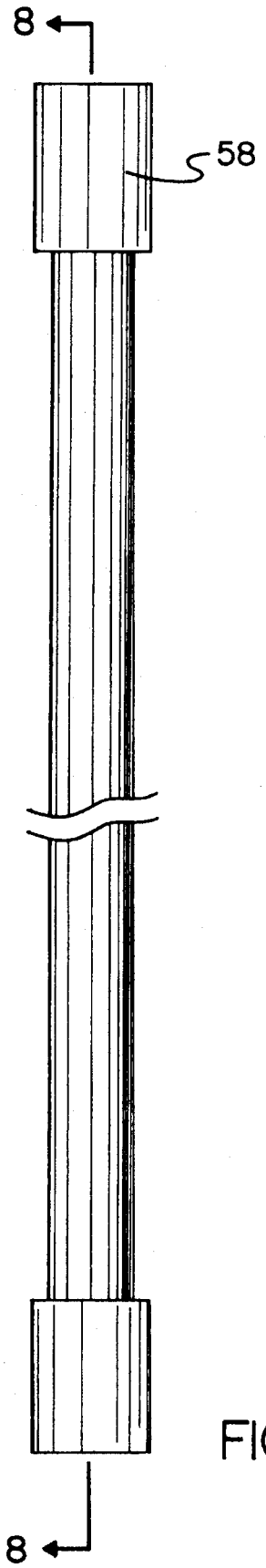
FIG. 7 is a view of a rod used to secure the screen within the frame of an opened window.
Figure 8:
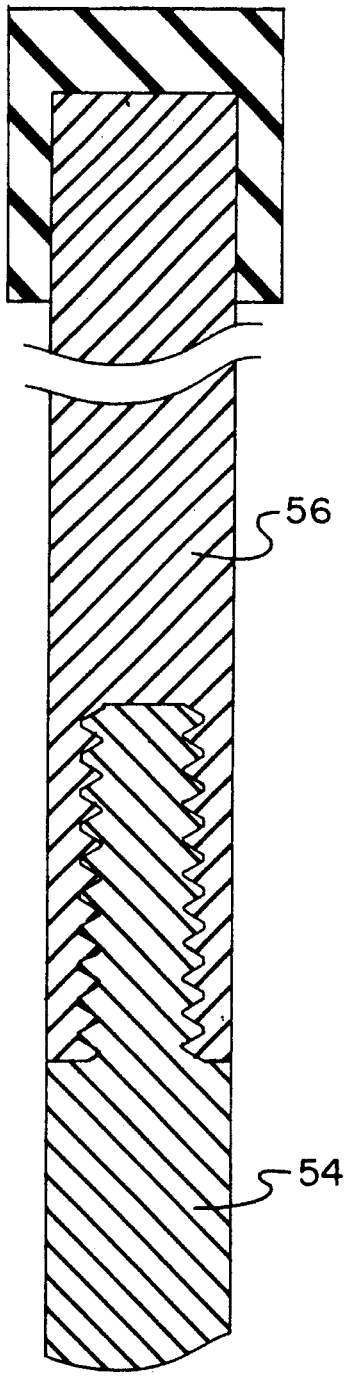
FIG. 8 is a cross sectional view of the coupling within the rod taken along the line 8—8 of FIG. 7.

With reference now to the drawings, and in particular, to FIG. 1 thereof, the preferred embodiment of the new and improved child safety window screen embodying the principles and concepts of the present invention and generally designated by the reference number 10 will be described.

Specifically, the present invention includes five major components. The major components are the rails, screen, rods, L-shaped bracket, and sets of screws. These components are interrelated to provide the intended function.

More specifically, it will be noted in the various Figures that the first major component are the rails. The device includes a top rail 12 and a bottom rail 26. The top rail has an upper edge 14, a lower edge 16, and an intermediate portion 18 therebetween. The upper edge has a U-shaped channel 20 formed thereon adapted for receiving and holding the bottom end of a window sash 22 therein. The intermediate portion has an aperture 24 axially disposed therethrough.

The bottom rail has an upper edge 28, a lower edge 30, and an intermediate portion 32 therebetween. The intermediate portion has an aperture 34 axially disposed therethrough. The lower edge has a plurality of spaced and aligned apertures 36 disposed thereon.

The second major component is the screen 40. The screen is essentially rectangular and flexible in structure. The screen has an upper edge 42 coupled to the lower edge 16 of the top rail. The screen has a lower edge 44 coupled to the upper edge 28 of the bottom rail.

The third major component of the device are the rods. The device includes a top rod 50 and a bottom rod 52. The top rod is slidably disposed within the aperture 24 of the top rail. The bottom rod is slidably disposed within the aperture 34 of the bottom rail. Each rod has a first member 54 threadably received in a second member 56 to allow axial extension thereof for coupling within the frame of an opened window. Each rod is positioned within the frame of an opened window at a distance offset from the other rod such that the screen is extended therebetween. The extended screen thus shields the opening. Each end of each rod has a tip 58 coupled thereto for preventing slippage within the frame.

Furthermore, each of the rails has a plurality of opened spaces 60 disposed thereon. The spaces are disposed near the ends of each rail. The spaces allow access to each rod therein for extension or retraction thereof.

The fourth major component is the L-shaped bracket 70. The L-shaped bracket has a base leg 72 coupled to a downwardly extending cross leg 74. The base leg is positioned to contact the bottom edge 76 of the frame of the opened window. The cross leg is positioned to abut a side edge 78 of the frame of an opened window. Each leg of the bracket has a plurality of spaced and axially aligned apertures 80 disposed thereon.

The fifth major component is the screws. The device includes a first set of screws 90. Each screw of the set is disposed through an aperture on the base leg 72 of the L-shaped bracket. Each screw is then coupled within an aperture on the lower edge 30 of the bottom rail. The screws secure the L-shaped bracket to the bottom rail.

The device includes a second set of screws 92. Each screw within the set is disposed through an aperture on the cross leg 74 of the L-shaped bracket. Each screw is then coupled to a side edge 78 of the frame of an open window. This coupling prevents inadvertent movement of the bottom rail 26 and bottom rod 52, thus allowing the screen to be held in an essentially stationary position within the frame of an open window. In the preferred embodiment, the rails and L-shaped bracket are composed of high impact plastic. The rods are made of metal or any other rigid material. The tips coupled to the ends of the rods are made of rubber. The screen is made of plastic, rubber, or any other flexible material. The screws are conventional in design and commercially available. The L-shaped bracket is adjustable on the base leg to fit on a window sill. A user would determine the needed depth of the L-shaped bracket on the sill, and align the holes closest to that depth, and then secure.

The screen can be decorative in design, having trailing ivy, moon and stars, flowers, a traditional Chippendale motif, or other decorations disposed thereon. The screen would have opened spaces to allow air to pass but would prevent a child from passing through. The screen can also be formed to prevent other objects from passing through the window such as insects.

The rails and L-shaped bracket would be composed of high impact plastic of a light color so as not to mar the window frames. The rubber tips are formed on the metal rod so as to not mar the window frame. The device can be used in conjunction with an existing window screen, since it does not extend completely within or across the entire width of a window. The screen is adapted to fit within the frame of an opened window.

The child safety window screen is portable in design and can be adjusted to fit within a variety of different sized window frames.

Even still another object of the present invention is to provide a new and improved child safety window screen that prevents a variety of objects from either exiting or entering an opened window. It can be wound in a stowed configuration or unwound for use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A child safety window screen for preventing a child from falling through an opened window comprising, in combination:

an elongated top rail having an upper edge, a lower edge, and an intermediate portion therebetween, the upper edge having a U-shaped channel formed thereon adapted for receiving and holding the bottom end of a window sash therein, the intermediate portion having an aperture axially disposed therethrough;

an elongated bottom rail having an upper edge, a lower edge, and an intermediate portion therebetween, the intermediate portion having an aperture axially disposed therethrough, the lower edge having a plurality of spaced and aligned apertures disposed thereon;

an essentially rectangular and flexible screen having an upper edge coupled to the lower edge of the top rail and a lower edge coupled to the upper edge of the bottom rail;

a top rod slidably disposed within the aperture of the top rail and a bottom rod slidably disposed within the aperture of the bottom rail, each rod having a first member threadably received in a second member to allow axial extension thereof for coupling within the frame of an opened window, each rod positioned within the frame of an opened window at a distance offset from the other rod such that the screen is extended therebetween, thus shielding the opening, each end of each rod having a tip coupled thereto for preventing slippage within the frame;

a plurality of open spaces disposed on the top rail and bottom rail for allowing access to each rod therein for extension or retraction thereof;

an L-shaped bracket having a base leg coupled to a downwardly extending cross leg with the base leg adapted to be positioned to contact a bottom edge of a frame of an opened window and the cross leg adapted to be positioned to abut a side edge of a frame of an opened window, each leg having a plurality of spaced and axially aligned apertures disposed thereon;

a first set of screws, each screw disposed through an aperture on the base leg of the L-shaped bracket and coupled within an aperture on the lower edge of the bottom rail, whereby securing the L-shaped bracket to the bottom rail; and a second set of screws, each screw disposed through an aperture on the cross leg of the L-shaped bracket and coupled to a side edge of the frame of an opened window, whereby preventing inadvertent movement of the bottom rail and bottom rod, thus allowing the screen to be held in an essentially stationary position within a frame of an opened window.

* * * * *